US006224431B1

(12) United States Patent
Fukase

(10) Patent No.: US 6,224,431 B1
(45) Date of Patent: May 1, 2001

(54) DOUBLE ENGAGEMENT STRUCTURE OF COUPLING TERMINAL IN PLUG TYPE CONNECTOR

(75) Inventor: Yoshihiro Fukase, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/650,674

(22) Filed: Aug. 30, 2000

(30) Foreign Application Priority Data

Aug. 31, 1999 (JP) ..... 11-245812

(51) Int. Cl.[7] ..... H01R 13/514
(52) U.S. Cl. ..... 439/752; 439/748
(58) Field of Search ..... 439/746, 748, 439/749, 752

(56) References Cited

U.S. PATENT DOCUMENTS 5,226,839 * 7/1993 Koumatsu et al. ..... 439/744
5,607,327 * 3/1997 Tsuji et al. ..... 439/752
5,624,284 4/1997 Gib et al. ..... 439/752
5,899,775 * 5/1999 Davis et al. ..... 439/748
6,050,860 * 4/2000 Tsuchiya ..... 439/748

FOREIGN PATENT DOCUMENTS 3-29276 8/1996 (JP) .

* cited by examiner

*Primary Examiner*—Neil Abrams
*Assistant Examiner*—Phuong Dinh
(74) *Attorney, Agent, or Firm*—Morgan, Lewis & Bockius LLP

(57) ABSTRACT

In the plug type connector 1 according to the present invention, a coupling terminal 3 to be inserted from the terminal housing rear portion 6 of a housing 2 is arranged in a manner that the casing 24*a* of a contact portion 24 supports on one side surface thereof a first engagement piece 25*a* to be engaged with a first engagement portion 10*b* on the inner surface of the housing 2 and also supports on the other side surface of the casing a second engagement piece of a sliding portion 4. The sliding portion 4 is protrusively provided with a detection projection 13 along a movable bent contact groove. Since the first engagement portion 10*b* and the second engagement portion are provided so as to be positioned to the same level, the sliding portion 4 engages the coupling terminal 3 with the first and second engagement portions 10*b* doubly through the casing 24*a* by means of the detection projection 13.

2 Claims, 11 Drawing Sheets

DOUBLE ENGAGEMENT STRUCTURE OF COUPLING TERMINAL IN PLUG TYPE CONNECTOR

BACKGROUND OF INVENTION

1. Field of Invention

The present invention relates to a plug type connector for coupling wiring within a vehicle such as an automobile and, more particularly, relates to the double engagement structure of a coupling terminal in a plug type connector which ensures that the coupling terminal is quickly and surely inserted into and engaged with the housing of the plug type connector.

2. Related Art

In a vehicle such as an automobile in which various kinds of electronic devices are mounted, the conventional plug type connector for connecting wire harness wired among the electronic devices is disclosed in U.S. Pat. No. 5,624,284, for example.

As shown in FIGS. 11 and 12, a housing 61 forming a part of the conventional plug type connector is received in a groove (not shown) provided at a sliding portion 51 along the longitudinal direction thereof. The sliding portion is provided with movable contact rooms 52 of a concave shape on both side surfaces thereof. The sliding portion is further provided on each of both sides thereof with a plurality of table portions 53 which are protrusively provided and separated from one another with a space corresponding to the width of each of a tongue shaped elastic first engagement piece 57*a* and a tongue shaped elastic second engagement piece 57*b* whose one ends are supported by the both side surfaces of a coupling terminal 54.

The upper end surface of the table portion 53 has a function as a first engagement portion 55 which engages with the other end of the first engagement piece 57*a* serving as a free end. In contrast, the table portion 54 is provided at the lower end of the side surface thereof with a projection portion 56 which avoids an electric wire fastening portion 58 and abuts against the bottom surface of the coupling terminal 54 so as to be able to lift the coupling terminal 54 in accordance with the movement of the slide portion 51 toward the direction shown by an arrow b.

Further, as shown in FIG. 12, a fixing contact room 62 is formed in a concave shape at the side wall of the housing in opposite to the side wall of the sliding portion 51. The lower end surface of the fixing contact room has a function as a second engagement portion 63 which engages with the other end of the second engagement piece 57*b* serving as a free end. The second engagement portion 63 is positioned at the portion slightly above the first engagement portion 55 arrived at its maximum upper limit.

In the case of assembling the coupling terminal 54 into the housing 61, firstly the slide portion 51 is slid along a groove (not shown) provided at the housing 61 so as to cross the housing and then inserted at a predetermined standby position of the housing in advance. Then, the coupling terminal 54 is entirely pressed into the housing toward the direction shown by an arrow a while sliding the first engagement piece 57*a* into the space between the table portions 58 of the sliding portion 51 and also sliding the second engagement piece 57*b* on the lower wall of the second engagement portion 63.

The first engagement piece 57*a* thus passed through the space between the table portions 58 is entirely housed within the movable contact room 52 together with it's the other end.

However, since the fixing contact room 62 is positioned above the movable contact room 52, the other end of the second engagement piece 57*b* is not housed within the fixing contact room 62, so that the elastically deformed configuration of the other end of the second engagement piece is maintained almost in a straight shape.

In this state, the sliding portion 51 is slid and pushed linearly to a predetermined position toward the direction shown by the arrow b in FIG. 11 thereby to engage the first engagement portion 55 with the other end of the first engagement piece 57*a*. Thereafter, the sliding portion 51 is further slid and pushed linearly to the predetermined position toward the direction shown by the arrow b, whereby a wedge portion 53*a* protrusively provided at the lower end surface of the table portion 58 moves straightly in such a manner that the protruded end surface of the wedge portion slides in a contacted manner on the protruded end surface of other wedge portion (not shown) of the bottom surface of the housing provided in opposite to the wedge portion 53*a*.

As a result, the sliding portion 51 moves upward. In this respect, on the way where the sliding portion moves upward to the position shown by a phantom line in FIG. 12, firstly the projection portion 56 abuts against the bottom surface of the coupling terminal 54, then soon moves the coupling terminal 54 upward, and thereafter the entirety of the coupling terminal including the other end of the second engagement piece 57*b* is housed within the fixing contact room 62.

Thus, the other end of the first engagement piece 57*a* and the other end of the second engagement piece 57*b* are positioned to the same level by the first engagement portion 55 and the second engagement portion 63, respectively. Therefore, the stress such as pulling force etc. is equally distributed and the projection portion 56 prevents the coupling terminal 54 from being dropped.

However, according to the aforesaid conventional plug type connector, when the initial assembling stage is terminated in a state that a part of the first engagement piece 57*a* of the coupling terminal 54 is remained within the space between the table portions 58, the part of the first engagement piece 57*a* is pushed in toward the lateral direction by the table portions 58 and remarkably deformed in the succeeding assembling stage for linearly sliding the sliding portion 51 in the direction shown by the arrow b.

Thus, the other end of the first engagement piece 57*a* can not be engaged with the first engagement portion 55. Therefore, the conventional plug type connector in a sate that the assembling process of the coupling terminal 54 has been completed has a problem that the first engagement piece 57*a* and the second engagement piece 57*b* can not be fixed with an equal engagement force.

Further, since the conventional plug type connector does not have a means for effectively detecting the abnormal insertion of the coupling terminal 54 in the initial assembling state thereof, the coupling terminal 54 is assembled within the housing in the aforesaid unstable state.

Thus, when the a pin or a blade serving as a male type terminal of a partner-side connector is inserted between elastic contact pieces 59 disposed at the tip end portion of the coupling terminal 54, there arises a problem that the coupling terminal 54 can not withstand against the insertion force of the male type terminal and so the entirety thereof is abnormally deformed or dropped out.

SUMMARY OF INVENTION

Accordingly, the invention has been made in order to obviate the aforesaid problems of the prior art, and an object of the invention is to provide a double engagement structure of a coupling terminal in a plug type connector which ensures that the coupling terminal is quickly and surely inserted into and engaged with a housing.

Such an object of the invention is attained by a double engagement structure of a coupling terminal in a plug type connector which is arranged in a manner that in the plug type connector wherein a sliding portion is fitted into a terminal housing front portion for receiving a contact portion which constitutes a part of a coupling terminal inserted from a terminal housing rear portion of the housing thereby to doubly engage the contact terminal, a double engagement structure of a coupling terminal in a plug type connector is characterized in that the coupling terminal is arranged in a manner that the casing of the contact portion thereof supports on one side surface thereof one end portion of a first engagement piece which engages with a first engagement portion formed by the step end surface of a fixing contact groove provided in a concave shape on the inner surface of the housing, and also supports on the other side surface of the casing one end portion of a second engagement piece which engages with a second engagement portion formed by the bent end surface of a movable bent contact groove provided in a concave shape on the flat surface of a base portion of the sliding portion, the sliding portion is protrusively provided with a detection projection on the flat surface of the base portion along the movable bent contact groove at the terminal housing rear portion side from the bent end surface of the movable bent contact groove, and the step end surface of the fixing contact groove and the bent end surface of the movable bent contact groove are provided so as to be positioned to the same level in the lateral direction of the terminal housing front portion.

In the aforesaid double engagement structure of the coupling terminal in the plug type connector, preferably, the sliding portion is provided at each of both side surfaces of the base portion with the movable bent contact groove and the detection projection.

The double engagement structure of the coupling terminal in the plug type connector is arranged in a manner that the coupling terminal is arranged in a manner that the casing of the contact portion thereof supports on one side surface thereof one end portion of the first engagement piece which engages with the first engagement portion formed by the step end surface of the fixing contact groove provided in a concave shape on the inner surface of the housing, and also supports on the other side surface of the casing one end portion of the second engagement piece which engages with the second engagement portion formed by the bent end surface of the movable bent contact groove provided in a concave shape on the flat surface of the base portion of the sliding portion, the sliding portion is protrusively provided with the detection projection on the flat surface of the base portion along the movable bent contact groove at the terminal housing rear portion side from the bent end surface of the movable bent contact groove, and the step end surface of the fixing contact groove and the bent end surface of the movable bent contact groove are provided so as to be positioned to the same level in the lateral direction of the terminal housing front portion.

Accordingly, when the sliding portion is preset at the first position with respect to the housing, it becomes possible that the sliding portion allows the casing to be assembled at the terminal housing front portion and also allows the other end portion of the first engagement piece to slide along the fixing contact groove and to engage with the first engagement portion.

Further, in the procedure of sliding and pushing the sliding portion toward the second position with respect to the housing, it is possible to detect whether or not the casing is suitably fitted in the terminal housing front portion in accordance with the movement of the detection projection together with the sliding portion.

Accordingly, the detection projection can move without being interfered by the abutment against the casing. Thus, when the sliding portion arrives at the second position, it becomes possible that the sliding portion allows the other end portion of the second engagement piece to slide along the movable bent contact groove and engage with the second engagement portion.

Further, when the sliding portion is set at the second position with respect to the housing, the detection projection serves as a stopper for the casing and prevents the casing from being dropped out. Thus, it becomes possible that the sliding portion engages the coupling terminal with the first and second engagement portions doubly through the casing by means of the detection projection.

DETAILED DESCRIPTION OF PREFERRED EMBODIMENTS

Figure 1:
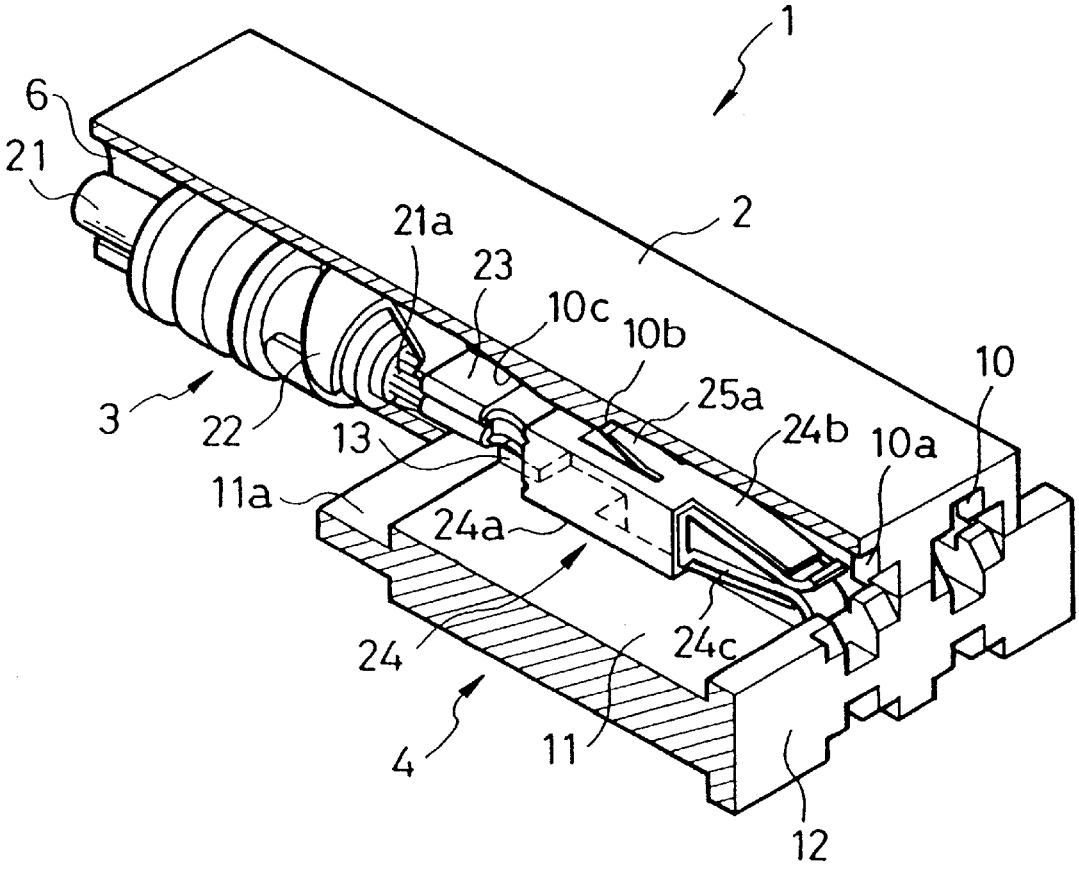
FIG. 1 is a partially cutaway perspective view of a main portion of the plug type connector according to the invention.
Figure 2:
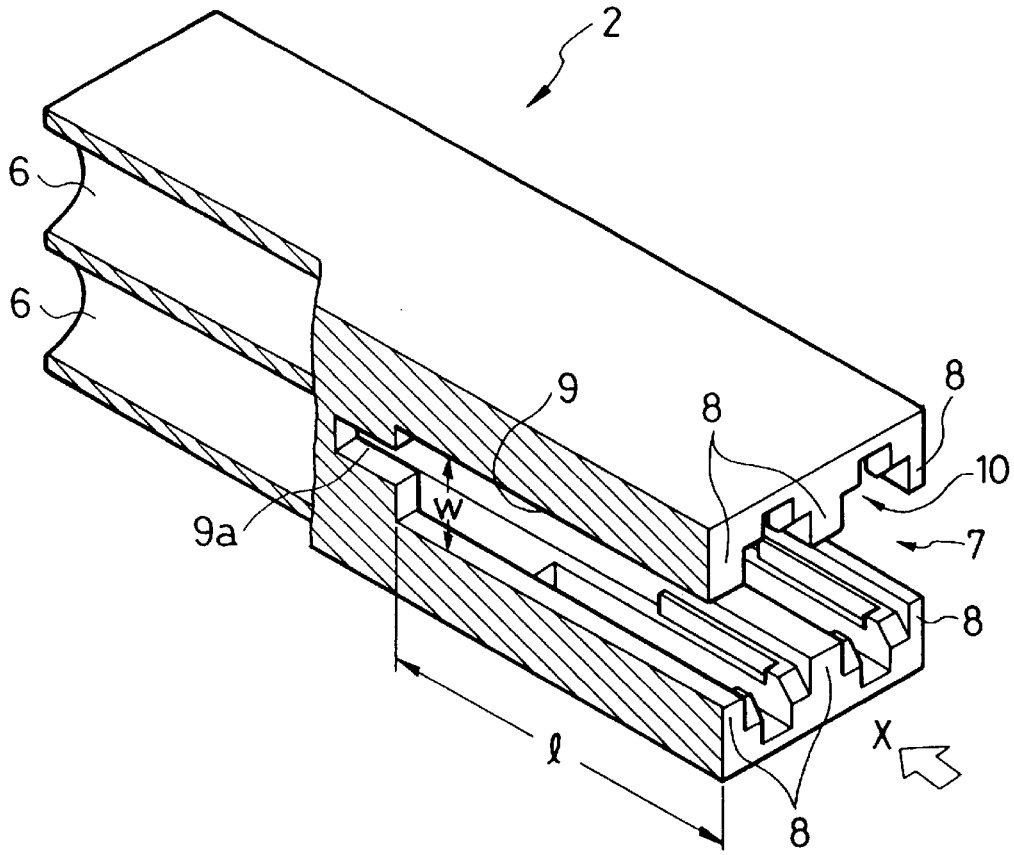
FIG. 2 is a partially cutaway perspective view of the main portion of the housing in FIG. 1.
Figure 3:
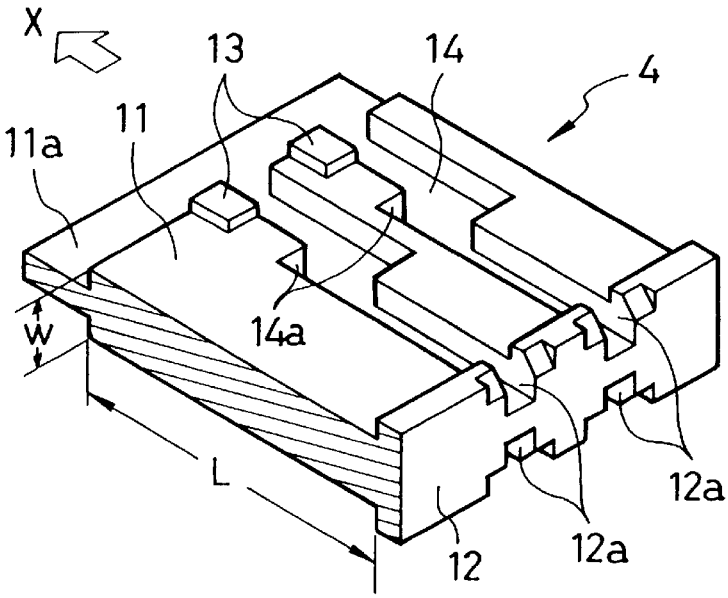
FIG. 3 is a perspective view of the sliding portion in FIG. 1.
Figure 6:
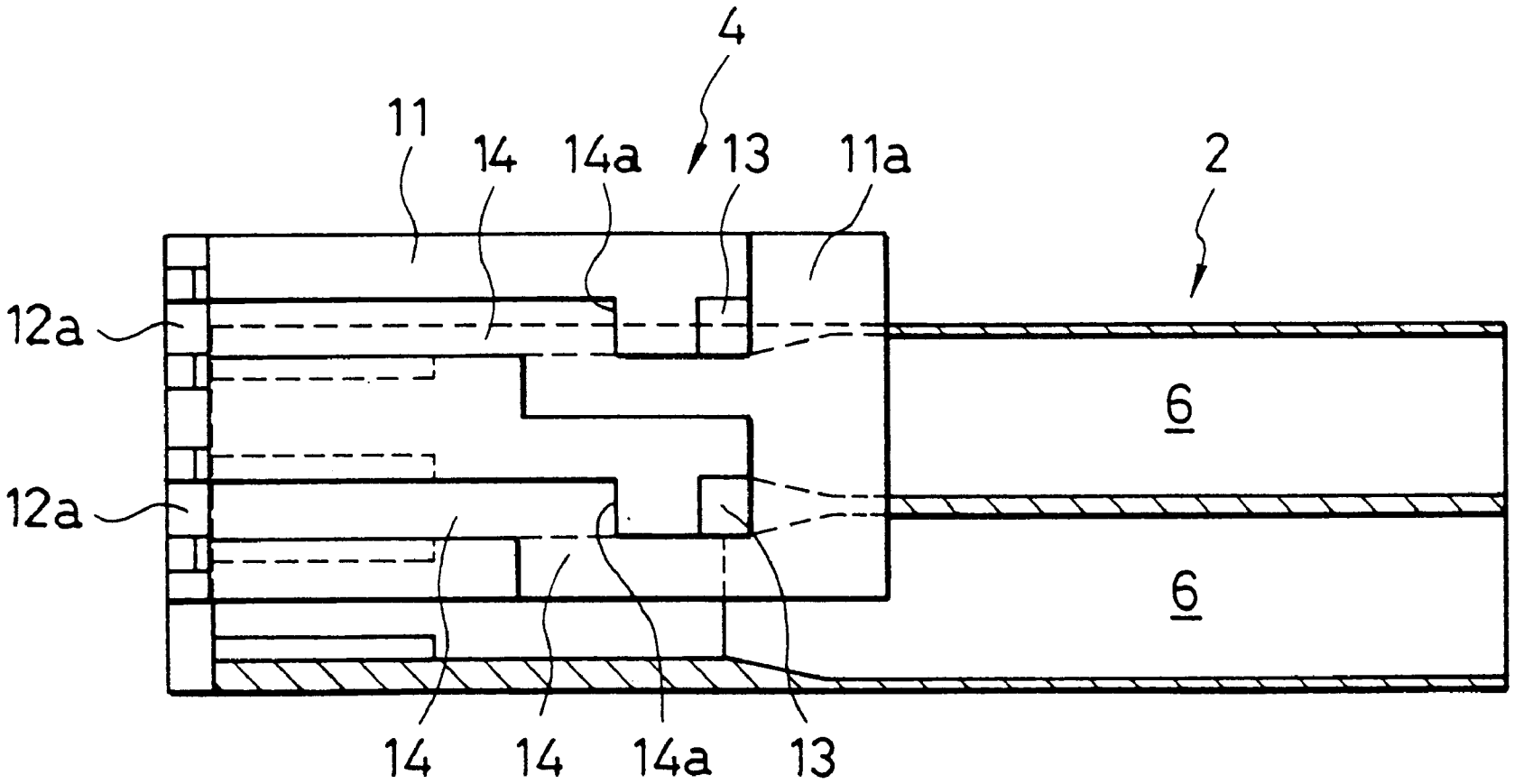
FIG. 6 is a plan view showing the positional relation of the sliding portion with respect to the housing of FIG. 4.
Figure 7:
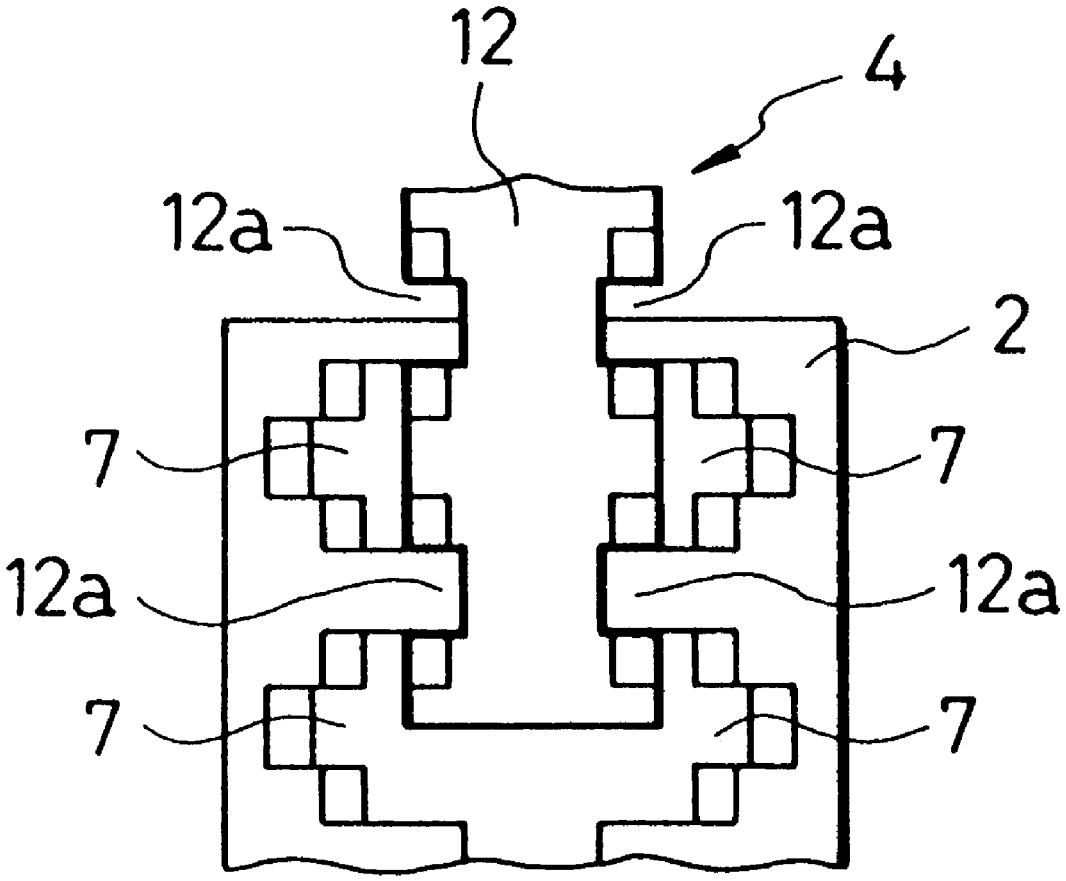
FIG. 7 is a front view showing the insertion process of the sliding portion with respect to the housing.
Figure 8:
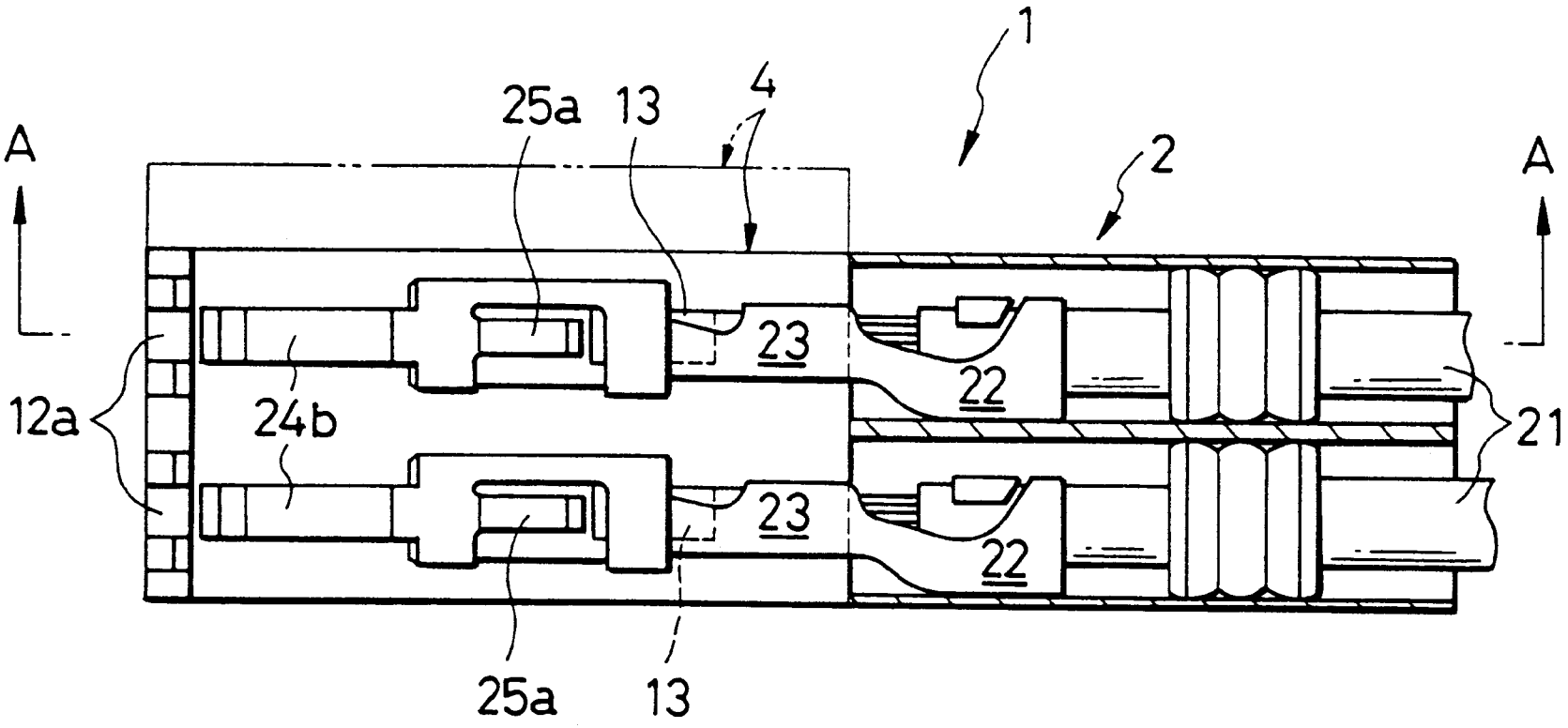
FIG. 8 is a partially cutaway plan view of the main portion of the plug type connector including the sliding portion set to the second position with respect to the housing.
Figure 9:
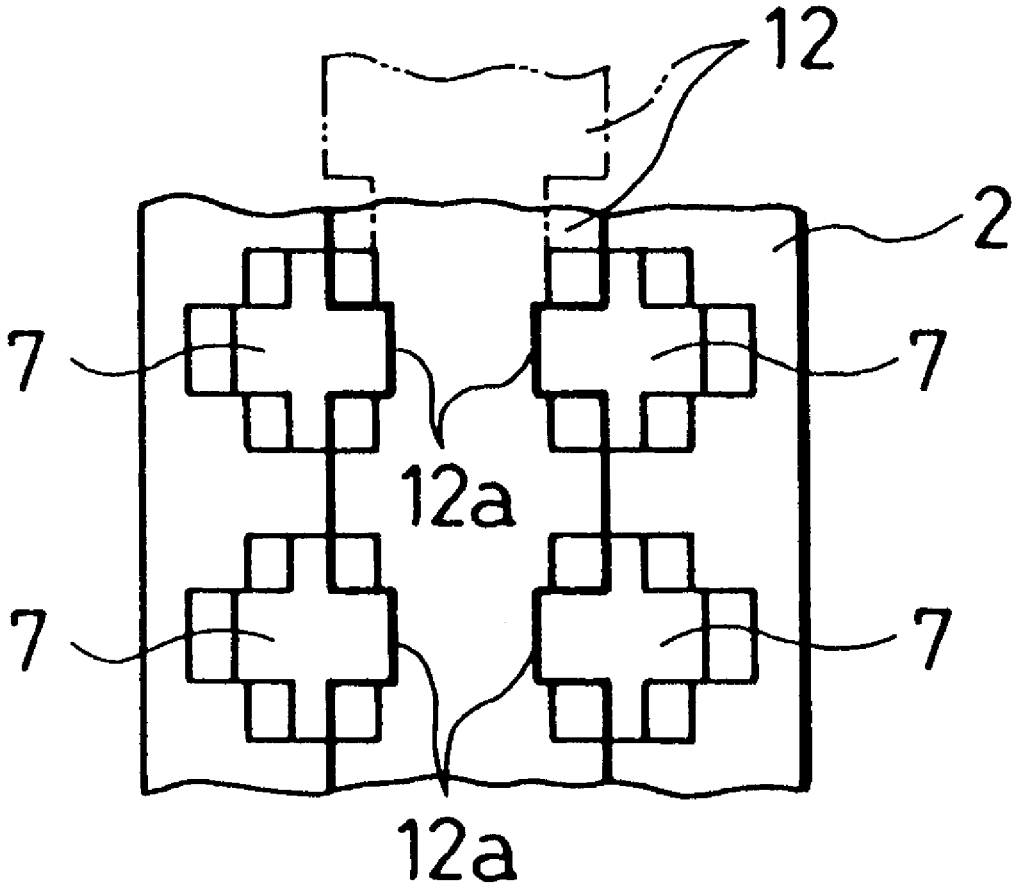
FIG. 9 is a front view showing a state where the fitting operation of the sliding portion into the housing is completed.
Figure 10:
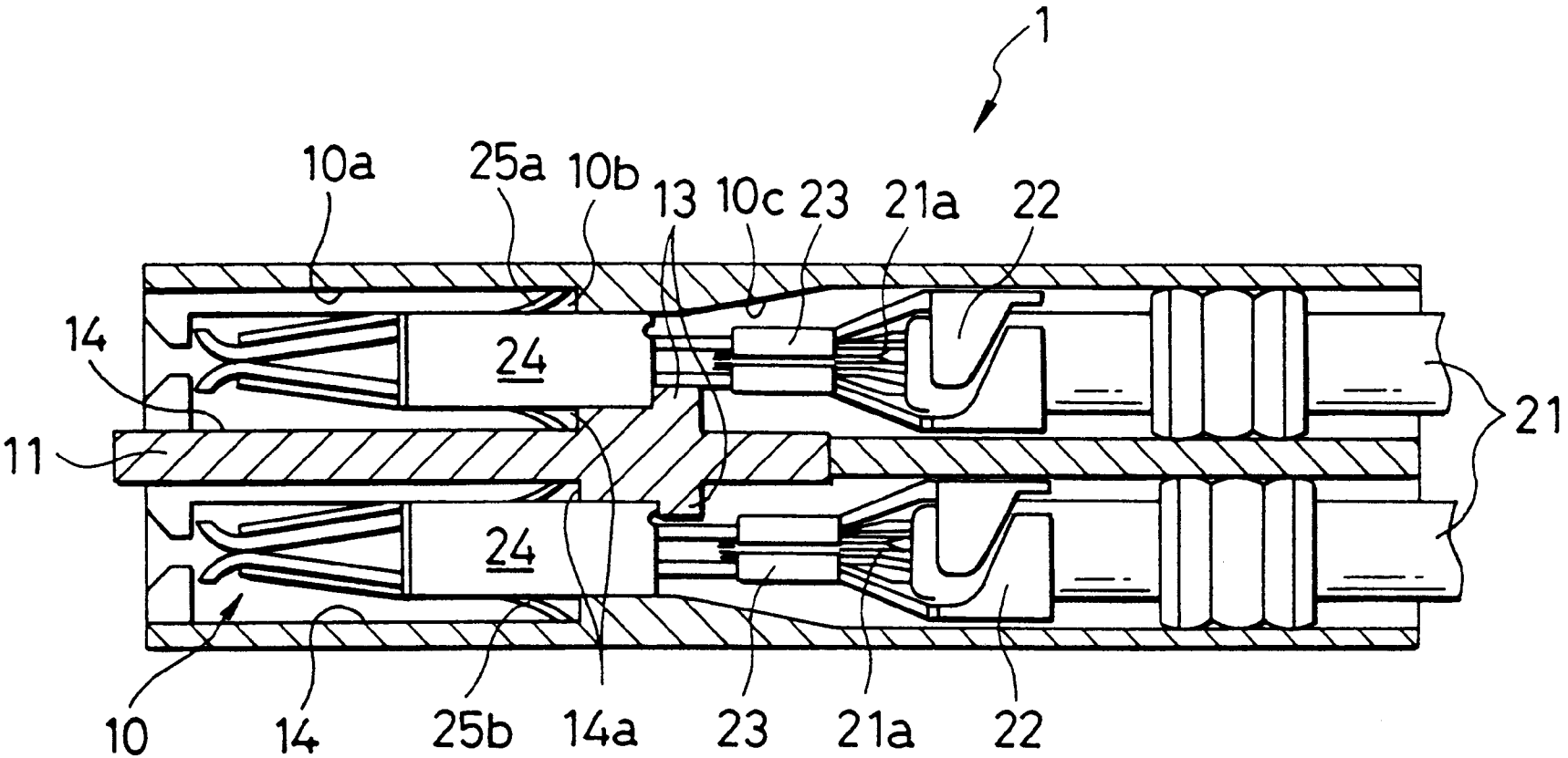
FIG. 10 is a longitudinal sectional view cut away along a line A—A in FIG. 8.
Figure 11:
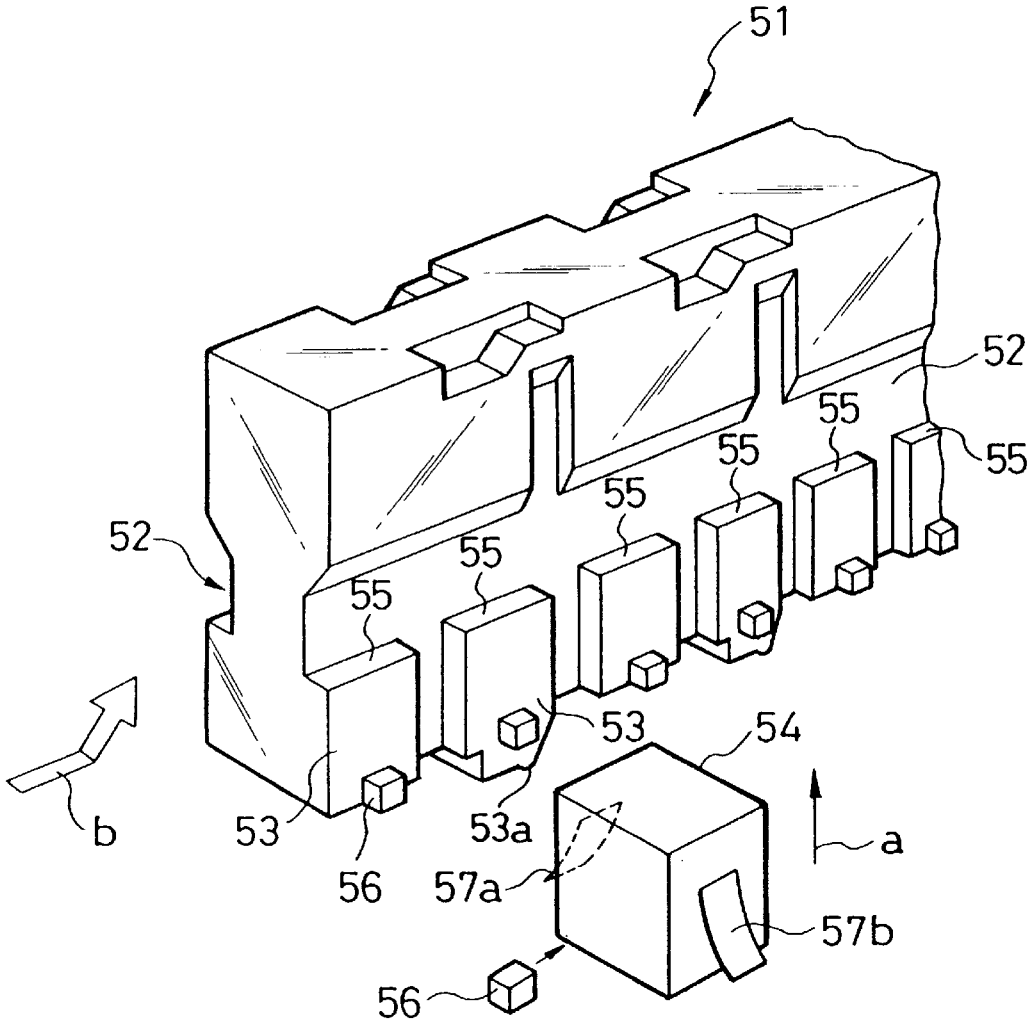
PRIOR ART FIG. 11
FIG. 11 is a perspective view of the sliding portion of a conventional plug type connector.
Figure 12:
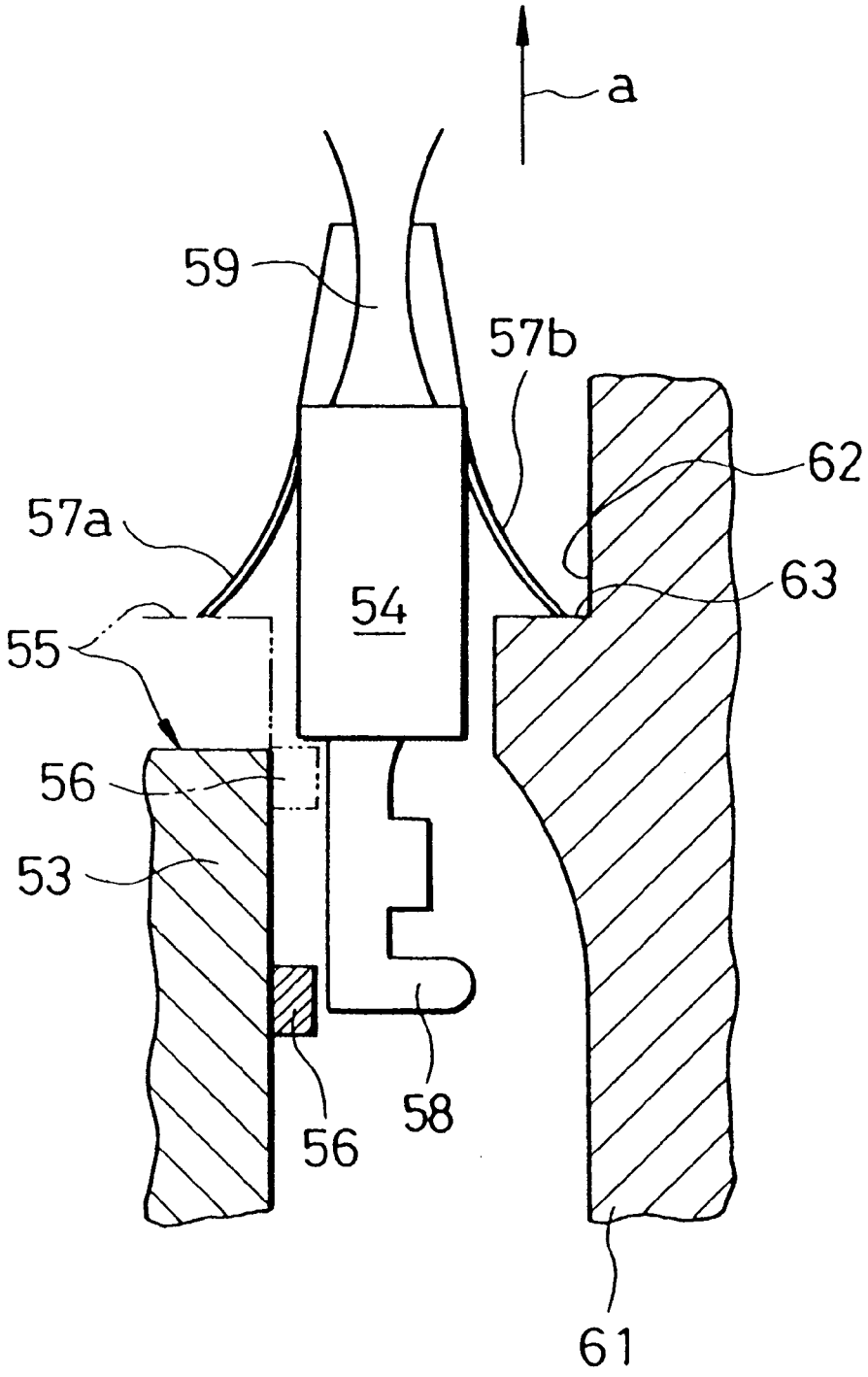
PRIOR ART FIG. 12
FIG. 12 is a partially cutaway side view of the main portion of the conventional plug type connector.

The double engagement structure of a coupling terminal in a plug type connector according to an embodiment of the invention will be explained in detail with reference to the accompanying drawings. FIG. 1 is a partially cutaway perspective view of a main portion of the plug type connector according to the invention, FIG. 2 is a partially cutaway perspective view of the main portion of the housing of the plug type connector according to the invention, FIG. 3 is a perspective view of the sliding portion of the plug type connector according to the invention, FIG. 4 is a partially cutaway perspective view of the main portion of the plug type connector according to the invention including the sliding portion positioned at a first position with respect to the housing, FIG. 5 is a partially cutaway perspective view of the main portion of the plug type connector according to the invention including the sliding portion slid toward a second position with respect to the housing, FIG. 6 is a plan view showing the positional relation of the sliding portion with respect to the housing of FIG. 4, FIG. 7 is a front view showing the insertion process of the sliding portion with respect to the housing, FIG. 8 is a partially cutaway plan view of the main portion of the plug type connector according to the invention including the sliding portion set to the second position with respect to the housing, FIG. 9 is a front view showing a state where the fitting operation of the sliding portion into the housing is completed, and FIG. 10 is a longitudinal sectional view cut away along a line A—A in FIG. 8.

Figure 4:
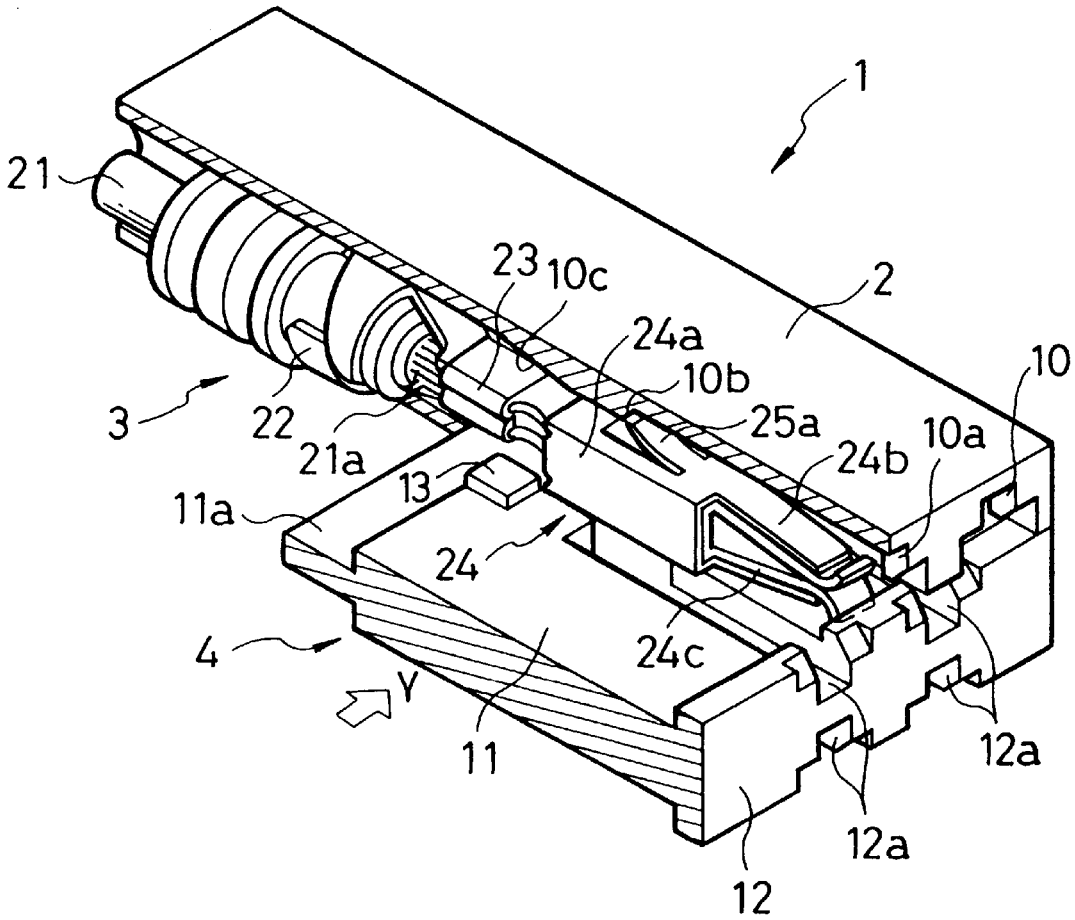
FIG. 4 is a partially cutaway perspective view of the main portion of the plug type connector including the sliding portion positioned at a first position with respect to the housing in FIG. 1.
Figure 5:
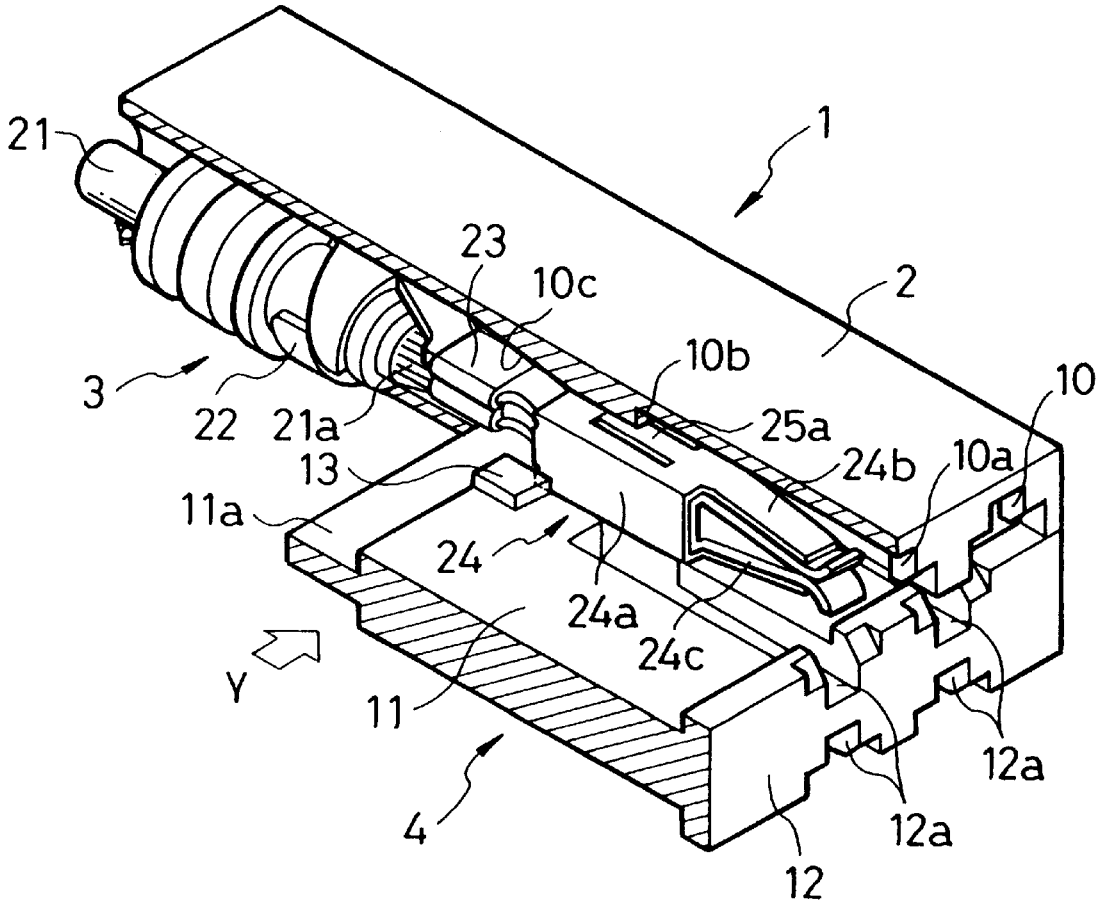
FIG. 5 is a partially cutaway perspective view of the main portion of the plug type connector including the sliding portion slid toward a second position with respect to the housing in FIG. 4.

A coupling terminal 3 to be inserted into the plug type connector 1 according to the invention is normally formed in a manner that a metal sheet is subjected to a folding process to form a fastening portion 22 for fastening the coating material 21 of an electric wire, a pressing portion 23 for pressing the core wire 21*a* of the electric wire, and a contact portion 24 electrically made in contact with the male type terminal of a partner-side connector (not shown) in accordance with the insertion thereof, as shown in FIGS. 1, 4 and 5.

The contact portion 24 has a casing 24*a* formed in an almost rectangular parallelepiped shape. As shown in FIG. 10, the contact portion is provided at its both side surfaces with tongue-shaped elastic first and second engagement pieces 25*a*, 25*b* which are elected therefrom, and further provided with a pair of tongue-shaped elastic contact pieces 24*b*, 24*c* which extend toward a terminal insertion inlet 7 from the front end portions of the both side surfaces of the casing 24*a*, respectively.

The male type terminal of the partner-side connector (not shown) is passed through the terminal insertion inlet 7 which is opened at the tip end surface 8 of a housing 2 constituting a part of the plug type connector 1 of the embodiment and then inserted with pressure into a space between the pair of opposed contact portions 24*b*, 24*c*. Thus, the partner-side connector is elastically made in contact with the pair of contact portions 24*b*, 24*c* and so maintained in an electrically conductive state therewith.

Then, as shown in FIGS. 1 and 2, the housing 2 includes a terminal housing rear portion 6 in which the entirety of the coupling terminal 3 is inserted and a terminal housing front portion 10 which engages with the casing 24*a* of the contact portion 24 forming a part of the coupling terminal 3. The terminal housing front portion 10 includes a stepped end surface at the most inner portion of a fixing contact groove 10*a* which is provided in a concave shape along the longitudinal direction on the inner surface of the terminal housing front portion. The stepped end surface serves as a first engagement portion 10*b* engaging with the free end portion of the first engagement piece 25*a* of the casing 24. The terminal housing front portion further includes a slanted surface 10*c* whose thickness is decreased gradually from the first engagement portion 10*b* toward the inner surface of the terminal housing rear portion 6.

Further, the terminal housing front portion 10 is provided at the tip end surface 8 and the both side walls thereof with a fitting groove 9 in a notched manner in the longitudinal direction thereof in which a sliding portion 4 for partitioning the terminal housing front portion 10 in the longitudinal direction thereof can be inserted in directions shown by arrows X and Y in FIGS. 2, 3 and 5, and further provided at the most inner portion of the fitting groove 9 with a guide groove 9*a* with a narrow width which guides the sliding portion 4 so that the sliding portion is fitted in the fitting groove.

As shown in FIG. 3, the sliding portion 4 includes a base portion 11 of a flat plate shape, a tip end plate 12 provided at the front edge of the base portion 11, and movable bent contact grooves 14 provided in a concave shape on the flat surfaces of the base portion 11. The sliding portion further includes second engagement portions 14*a* which are formed by the bent end surfaces of the movable bent contact grooves 14 and engage with the free end portion of the second engagement pieces 25*b* of the casings 24*a*. The sliding portion furthermore includes detection projections 13 protrusively provided on the flat surface of the base portion 11 along the movable bent contact grooves 14 at the terminal housing rear portion 6 side from the bent end surface of the movable bent contact grooves 14, and a smooth movement restricting step 11*a* which is formed by reducing the thickness of the rear edge of the base portion 11 along the entire width thereof.

Further, the tip end plate 12 is provided with notch portions 12*a* which are formed by the notching process and form a part of the terminal insertion inlet 7 opened at the tip end surface 8 of the housing 2. The notch portions 12*a* communicate with the movable bent contact grooves 14. The effective length L and width W of the sliding portion 4 are set so as to coincide with the effective length l and width w of the fitting groove 9, respectively. The smooth movement restricting step 11*a* suitably restricts the smooth movement of the sliding portion 4 toward the direction shown by the arrows X and Y when the sliding portion is fitted into the guide groove 9*a* of the fitting groove 9.

The detection projection 13 detects whether or not the casing 24*a* exists in the procedure where the sliding portion 4 slides from the first position relative to the housing 2 shown in FIGS. 1, 2, 6 and 7 to the second position relative to the housing 2 shown in FIGS. 8 to 10. The detection projection further prevents the second engagement piece 25*b* of the casing 24*a* engaging with the second engagement portion 14*a* at the second position from being dropped out.

It is preferable to provide the step end surface of the fixing contact groove 10*a* and the bent end surface of the movable bent contact groove 14 so as to be positioned at the same level in the lateral direction of the terminal housing front portion 10, in order to equally distribute the stress generated at the first and second engagement pieces 25*a*, 25*b* by the insertion force of the male type terminal of the partner-side connector. However, it is possible to dispose the step end surface of the fixing contact groove and the bent end surface of the groove so as to have a level difference therebetween.

Further, in the case of inserting a multiplicity of the coupling terminals 3 within the housing 2, the sliding portion 4 may be arranged in a manner that the base portion 11 is provided at both sides thereof with the movable bent contact grooves 14 and the detection projections 13 so that the sliding portion is received within the housing 2 in two stages.

The assembling procedure of the sliding portion 4 into the housing 2 will be explained. First, as shown in FIGS. 2, 3, 6 and 7, the notch portions 12*a* of the tip end plate 12 of the sliding portion 4 are shifted in the direction shown by the arrow Y by ½ pitch with respect to the terminal insertion inlet 7 of the tip end surface 8 and then the entirety of the sliding portion 4 is pushed into the housing from the tip end surface 8 of the housing 2 toward the direction shown by the arrow X.

Further, the sliding portion is continuously pushed thereby to fit the base portion 11 into the fitting groove 9 provided at the terminal housing front portion 10 and also fit the smooth movement restricting step 11*a* into the guide groove 9*a,* whereby the sliding portion 4 is preset at the first position. In the first position shown by a steady line of FIG. 6 or a phantom line of FIG. 8, the detection projection 13 is waiting at the position not interfering the insertion of the coupling terminal 3 between the terminal housing rear portion 6 and the terminal housing front portion 10.

Thereafter, the coupling terminal 3 is inserted from the terminal housing rear portion 6 side. In this case, the free end portion of the first engagement piece 25*a* of the casing 24*a* moves over the slanted surface 10*c* while being pressed by the slanted surface 10*c*. Then, the first engagement piece 25*a* proceeds along the fixing contact groove 10*a,* and the free end portion of the first engagement piece 25*a* is released from the pressing force and engages with the first engagement portion 10*b*.

On the other hand, although the second engagement piece 25*b* proceeds toward the bottom surface of the movable bent contact groove 14 while being slightly pressed by the flat surface of the smooth movement restricting step 11*a,* the free end portion of the second engagement piece 25*b* is placed in such a state that the free end can not engage with the second engagement portion 14*a* of the movable bent contact groove 14.

As described above, when the coupling terminal 3 is normally inserted within the housing 2, since the detection projection 13 waits at the position not crossing with the rear end of the casing 24*a* as shown in FIG. 4, the entirety of the sliding portion 4 is not interfered in its sliding movement toward the direction shown by the arrow Y. Thus, the entirety of the sliding portion 4 is slid to the second position with respect to the housing 2 so that the notch portions 12*a* move in the direction shown by the arrow Y by ½ pitch with respect to the terminal insertion inlet 7.

As a result, as shown in FIG. 9, the terminal insertion inlet 7 in a fully opened state is defined, and the free end portion of the second engagement piece 25*b* engages with the second engagement portion 14*a* due to the movement of the movable bent contact groove 14 toward the direction shown by the arrow Y. In contrast, the detection projection 13 moves to the position abutting against the rear end surface of the casing 24*a* thereby to close a path along which the casing 24*a* moves backward. Thus, the assembling procedure of the sliding portion 4 into the housing 2 is completed.

When the coupling terminal 3 is not normally inserted within the housing 2, as shown in FIG. 5, the first engagement piece 25*a* is kept in a state being pressed by the slanted surface 10*c*. Thus, the detection projection 13 waits at the position abutting against side wall of the casing 24*a,* so that the entirety of the sliding portion 4 can not be slid to the second position with respect to the housing 2.

Accordingly, whether or not the coupling terminal 3 can be fitted within the housing 2 is surely detected depending on whether or not it is possible to slide the entirety of the sliding portion 4 to the second position with respect to the housing 2.

As described above, the double engagement structure of the coupling terminal in the plug type connector according to the invention is arranged in a manner that the coupling terminal is arranged in a manner that the casing of the contact portion thereof supports on one side surface thereof one end portion of the first engagement piece which engages with the first engagement portion formed by the step end surface of the fixing contact groove provided in a concave shape on the inner surface of the housing, and also supports on the other side surface of the casing one end portion of the second engagement piece which engages with the second engagement portion formed by the bent end surface of the movable bent contact groove provided in a concave shape on the flat surface of the base portion of the sliding portion, the sliding portion is protrusively provided with the detection projection on the flat surface of the base portion along the movable bent contact groove at the terminal housing rear portion side from the bent end surface of the movable bent contact groove, and the step end surface of the fixing contact groove and the bent end surface of the movable bent contact groove are provided so as to be positioned to the same level in the lateral direction of the terminal housing front portion.

Accordingly, when the sliding portion is preset at the first position with respect to the housing, it becomes possible that the sliding portion allows the casing to be assembled at the terminal housing front portion 10 and also allows the other end portion of the first engagement piece to slide along the fixing contact groove and to engage with the first engagement portion.

Further, in the procedure of sliding and pushing the sliding portion toward the second position with respect to the housing, it is possible to detect whether or not the casing is suitably fitted in the terminal housing front portion in accordance with the movement of the detection projection together with the sliding portion.

Accordingly, the detection projection can move without being interfered by the abutment against the casing. Thus, when the sliding portion arrives at the second position, it becomes possible that the sliding portion allows the other end portion of the second engagement piece to slide along the movable bent contact groove and engage with the second engagement portion.

Further, when the sliding portion is set at the second position with respect to the housing, the detection projection serves as a stopper for the casing and prevents the casing from being dropped out, so that it becomes possible that the sliding portion engages the coupling terminal with the first and second engagement portions doubly through the casing by means of the detection projection.

What is claimed is:

1. A double engagement structure of a coupling terminal A plug type connector comprising:

a housing;

a plurality of terminal housing formed in the housing;

a sliding portion fitted into a terminal housing front portion for receiving a contact portion defined by a part of a coupling terminal inserted from a terminal housing rear portion of said housing;

a first engagement piece engaged with a first engagement portion defined by a step end surface of a fixing contact groove provided in a concave shape on an inner surface of said housing, an one end of said first engagement piece supported by an one side surface of a casing;

a second engagement piece engaged with a second engagement portion defined by a bent end surface of a movable bent contact groove provided in a concave shape on a flat surface of a base portion of said sliding portion, an one end of said second engagement piece supported by the other side surface of said casing; and a detection projection provided protrusively provided on said flat surface of said base portion of said sliding portion along said movable bent contact groove which is close to said terminal housing rear portion side rather than said bent end surface of said movable bent contact groove, wherein said step end surface of said fixing contact groove and said bent end surface of said movable bent contact groove are provided so as to be positioned to a same level in a lateral direction of said terminal housing front portion.

2. A double engagement structure of a coupling terminal in a plug type connector according to claim 1, said sliding portion is provided at each of both side surfaces of said base portion with said movable bent contact groove and said detection projection.

* * * * *